US005219153A

United States Patent [19]

Dietz

[11] Patent Number: 5,219,153

[45] Date of Patent: Jun. 15, 1993

[54] PLACEMENT AID FOR MAKING STRAW STARS

[76] Inventor: Rolf A. H. Dietz, Königsberger Str. 45/1, W-6930 Eberbach, Fed. Rep. of Germany

[21] Appl. No.: 893,124

[22] Filed: Jun. 3, 1992

Foreign Application Priority Data

[30] Jun. 4, 1991 [DE] Fed. Rep. of Germany..9106850
Jun. 4, 1991 [DE] Fed. Rep. of Germany..9106851
Jun. 4, 1991 [DE] Fed. Rep. of Germany..9106852

[51] Int. Cl.[5] ..... B25B 1/20

[52] U.S. Cl. ..... 269/40; 269/203

[58] Field of Search ..... 294/93, 94, 86.24, 86.28; 269/48.1, 40, 37, 203, 254; 29/229, 243.56

[56] References Cited

U.S. PATENT DOCUMENTS

| | | | |
|---|---|---|---|
| 1,958,638 | 5/1934 | Olen | 29/229 |
| 1,986,957 | 1/1935 | Cargill | 294/93 |
| 2,282,767 | 5/1992 | Peterson | 294/93 |
| 3,113,799 | 12/1963 | Budnik | 269/254 |

*Primary Examiner*—Robert C. Watson
*Attorney, Agent, or Firm*—Peter K. Kontler

[57] ABSTRACT

A placement aid for making straw stars has a locking ring (10), which has an interruption (11) and by shortening said interruption can, in opposition to a restoring force, be fitted into the post ring (3, 4, etc.) of the central disk (14).

9 Claims, 6 Drawing Sheets

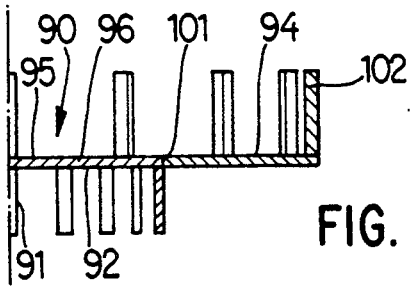
FIG. 18
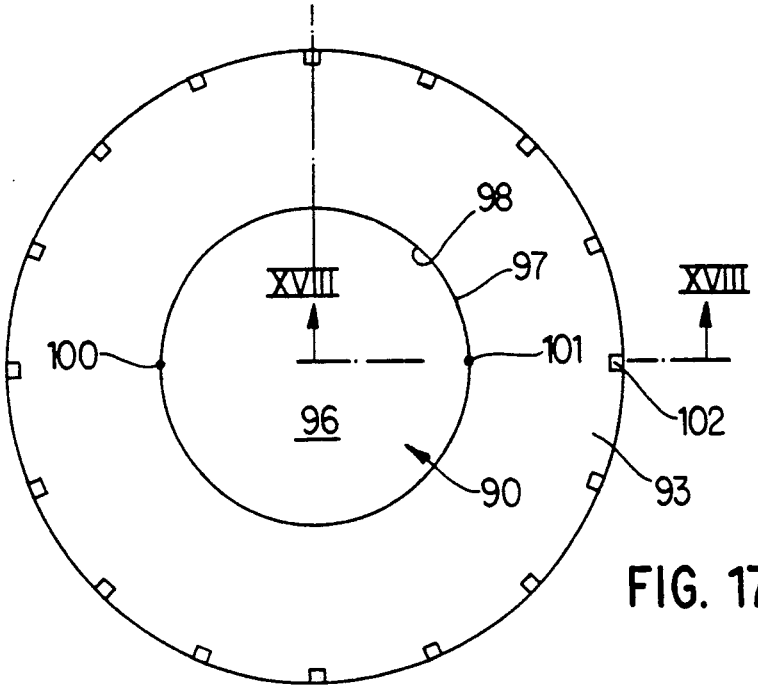
FIG. 17
FIG. 19
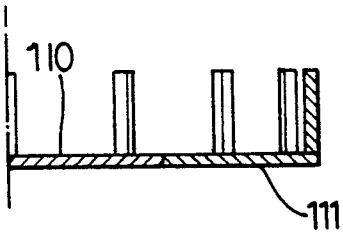
FIG. 20
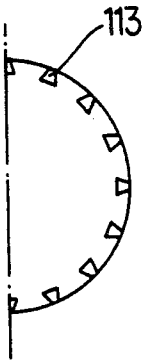
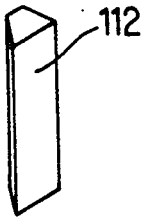
FIG. 21

PLACEMENT AID FOR MAKING STRAW STARS

BACKGROUND OF THE INVENTION

The invention relates to a placement aid for making straw stars with a placement part formed from a central disk, in whose top surface is anchored a ring of vertical posts, and with a loose locking ring, which fits in interlocking, rigid manner in the rod ring under elastic bracing.

In a known placement, laying or spreading aid of this type straw strips formed from longitudinal columns of straw members are placed in intersecting manner between the posts or rods on the top of the central disk, so that they form the design of a star and their ends project over the central disk. Said projecting ends are intersected by the straw strips and at the intersections they are interconnected, so that the placed or spread straw star receives its support or hold, so that it can be removed from the placement aid after the making of the said connections.

For the formation and binding of the straw star, particularly in the case of stacked straw strip layers, are facilitated by the locking ring, which is placed from above on the already reached straw strip layer and compresses and holds together the same for binding purposes or for provisional retaining during an interruption of placement. In a known placement aid of this type the locking ring is a closed rubber ring.

SUMMARY OF THE INVENTION

An object of the invention is to so construct the locking ring that when inserted it has a reliable hold due to bracing and is also able to offer a resistance to the lifting forces emanating from the straw strip layer and is also easily removable. It must also be borne in mind that such placement aids are used by small children, whose fingers cannot apply such strong forces.

According to the invention this object is accomplished in that the locking ring is circumferentially provided with an interruption or break forming an opening, the two locking ring ends defining the opening can be moved towards one another against a restoring force inherent in the locking ring and whilst shortening the interruption and with the interruption shortened the locking ring fits with clearance into the rod ring, whereas this is not the case when the interruption is lengthened.

Such a locking ring can be constructed in such a way that when relieved it is located with considerable tension and therefore a high locking action in the ring of rods. However, it can easily be removed and it is merely necessary for this purpose to correspondingly shorten the interruption or break.

The resiliency of the locking ring can be reinforced in that the interruption is bridged by a U-shaped clip.

The associated handling can be aided in that the two locking ring ends have in each case a handle remote from the central disk with the locking ring inserted and which are advantageously positioned along the legs of the U-shaped clip.

Such a handle can be a projection, which can easily be gripped from above with the fingers. However, it can also be in the form of recesses in which can be inserted the fingers or tweezers. It is preferable for the handles to be in the form of projections, because they can be more easily manipulated.

It is desirable that when the locking ring is inserted no straw strips can project into the interruption and hinder the shortening thereof. This can be taken into account by a corresponding orientation of the locking ring on insertion. It can also be prevented in that on one or both locking ring ends there are projections projecting into the interruption and which in the case of projections on both locking ring ends overlap when the interruption is lengthened and which are not aligned when the locking ring ends are aligned.

It is advantageous in this case that recesses are provided in the facing locking ring ends for the projection or projections and in same the particular projection is housed when the interruption is shortened.

The projections are appropriately constructed in such a way that they are aligned with the locking ring underside facing the central disk when the locking ring is inserted and consequently extend into the interruption or break the bearing on the straw star.

The smaller the lift necessary for the given tension in order to shorten the interruption for removing or inserting the locking ring, the easier is the handling and the less the risk that the shortening could be impeded by straw strips projecting into the interruption.

This is taken into account by a further development, which is characterized in that in each case one projection is provided on each of the locking ring ends and that said projections have opposite guides and form a stop, which limits the expansion of the interruption in a state in which the spring tension inherent in the locking ring is directed at a further lengthening of the interruption, but does not fit into the post ring.

The spreading or lengthening of the interruption or break can easily be limited in such a way that it is just sufficient to brace the inserted locking ring. It is then merely necessary to slightly shorten the interruption for inserting the loose locking ring in the post ring.

As the locking ring is pretensioned in its spreading position limited by the stop, the tension with which it is to be fitted, as a result of the action of the stop, is no longer dependent on the lift or travel by which the interruption is shortened for inserting the locking ring.

In the simplest case the locking ring cross-section is rectangular, namely with two sides of the rectangle plane-parallel to the ring plane.

In the known placement aid the posts stand vertically on the central disk surface. The locking ring with the rectangular cross-section then fits in interlocking or positive manner into the cross-sectional shape of the open space between the surface of the central disk and the inside of the post ring. If an open space with a different cross-sectional shape is to be defined between the posts and the central disk, then it is either necessary to insert a locking ring with a rectangular cross-section, or a locking ring, whose cross-section is positively adapted to the cross-sectional shape of said open space. Finally, it is also possible to insert a locking ring having a round or oval cross-section. The round and rectangular cross-sectional shape is preferred, because it is easier to produce and is more generally usable. The positively fitted, non-round and non-rectangular cross-sectional shape is preferred if it is a question of obtaining a maximum positive engagement on the one hand in order to tightly compress the packing of the straw star and on the other to ensure a sufficient frictional hold on the posts.

In many cases it is desirable to predetermine the angular orientation of the locking ring relative to the post ring. This can be achieved in that one or more circumferentially distributed, radially outwardly projecting tongues are provided on the locking ring and which are so narrow in the circumferential direction that they fit between two adjacent posts. Such tongues can easily be produced in such a way that they contribute to the reinforcement of the locking action, in that they only fit in clamping or locking manner between two adjacent posts.

The essential design of the star is formed within the post ring. The finished star only projects by the straw strip ends and the connections at the intersections are close to the circumference of the placement aid. Therefore the size of a straw star is limited by the diameter of the placement aid.

To avoid a slipping down from the posts caused by a great pressure from the pressed straw star the locking ring could be worked out with larger clamping or locking power. But this is not desirable in each case. It is easier to avoid a slipping by providing roughness, projections, indentations or the like forming sliding brakes on the outside of the locking ring and/or on the inside of the posts.

It would be desirable to provide placement and making aids for larger straw stars.

For this purpose a placement aid with a correspondingly larger diameter could be provided. The problem of a further development of the invention is to reduce the necessary extra expenditure in this connection during the manufacture of the placement aid. This problem is solved in that a loose extension or lengthening ring is provided, which is fitted in coaxially rigidly seated manner on the circumference of the central disk, so as to extend the latter radially outwards and that a ring of posts or rods is provided, whose posts or rods are anchored or anchorable on the top of the extension ring. Thus, for straw stars with two different sizes it is merely necessary to have a central disk and an additional extension ring.

When placing or spreading a straw star with fitted extension ring the posts of the central disk may possibly be in the way. There are two solutions for obviating this problem. In one solution in the case of a fitted extension ring the smooth underside of the central disk is aligned with the top of the extension ring, in that the top of the latter pointing upwards is applied to the central disk, whose top points downwards, i.e. is reversed. The posts of the central disk are then located on that side of the placement aid, which is remote from the straw star to be placed and are out of the way.

In the second solution the top of the extension ring aligned with the top of the central disk is placed on the latter, in that the upwardly pointing top of the extension ring is applied to the top of the central disk which is also pointing upwards, i.e. is not reversed and that the posts of the central disk are removable and are removed when the extension ring is fitted. This solution is somewhat more complicated because the posts must have a removable construction, but offers the advantage that the not required or impeding posts do not project from the underside of the placement aid, where they might be prejudicial to handling.

If other straw star sizes are to be made, then it is merely necessary to have a second, loose extension ring which, in the same way as the first extension ring on the central disk is applied to the first extension ring and this procedure is containued with any further extension rings provided.

With the posts which may be in the way when inserting said additional extension rings, the placement aid can be constructed as described in connection with the two aforementioned solutions in that the central disk posts and possibly those of one or more extension rings, with the exception of the outermost extension ring, can be removed from the surface defined by the outermost extension ring or this can take place by the reversed fitting of the central disk and possibly the relevant inner extension rings.

In the described known placement aid the central disk surface is a plane, so that each star made is planar or flat. The problem of a further development of the invention is to offer an aid for the making of domed or curved straw stars.

This problem is solved in that the top of the central disk is curved upwards in centrosymmetrical manner. The straw strips are initially straight and are then appropriately precurved, in that they are drawn between a hard edge, a thumb nail, and a soft opposite member, e.g. an index finger tip. When the original inside of the straw slides over the edge, the straw strip is permanently domed with the original outside pointing outwards.

The straw strips, preferably precurved in the manner described hereinbefore, are placed with the straw outside pointing upwards on the domed top of the central disk, so as to form a domed star. The curvature of the latter is fixed by the locking ring and then the ends, as for a flat star, are interconnected.

The domed top can be shaped onto the central disk, but can also be formed by a loose insert part positively fitting onto the central disk having the planar top and between the post ring. The insert part can appropriately be fixed by slight force fit with respect to the post ring.

It is advantageous to predetermine the angular orientation of the insert part and this can easily be brought about in that one or more circumferentially distributed, radially outwardly projecting tongues are provided on the insert part and which are so narrow in the circumferential direction that they fit between two adjacent posts. In such a case the desired force fit can be brought about by the tongues, in that they lock between two adjacent posts.

The curvature or doming of the top can be circular in bend-free manner, but can also be formed or concomitantly formed by bending edges.

The posts can extend parallel to the axis of the central disk, but can also slope outwards, preferably in accordance with the curvature, so that they stand vertically on the outer edge of the dome or curvature.

BRIEF DESCRIPTION OF THE DRAWINGS

The invention is described in greater detail hereinafter relative to nonlimitative embodiments and the attached drawings, wherein show:

FIG. 17 In plan view a placement aid enlarged by a fitted extension ring.

FIG. 18 Section XVIII from FIG. 17

FIG. 19 Another construction of a placement aid enlarged by an extension ring in a sectional view corresponding to FIG. 18, but in which the posts which are in the way have been removed.

FIG. 20 The central disk of FIG. 9 seen from above.

FIG. 21 A post of the central disk of FIG. 20.

DETAILED DESCRIPTION OF THE PREFERRED EMBODIMENTS

Figure 2:
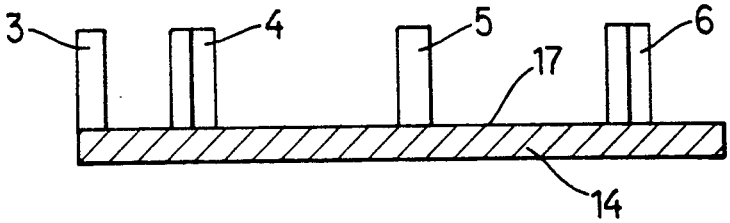
FIG. 2 The section II from FIG. 1, but without the locking ring and straw strips.

So as not to overburden the representation the straw strips have been omitted from FIG. 2 ff.

In the drawings 1 is a placement or spreading aid, which comprises a circular plastic disk 2, over whose circumference are uniformly distributed in centrosymmetrical manner identically large posts or rods 3 to 9, which extend at right angles to the plane defined by the said central disk 14.

A locking ring 10 is inserted in this ring of rods or posts and is provided on its circumference with an interruption or break 11 forming an opening. The locking ring 10 is made from an elastic material, so that the two ring ends 12, 13 forming the interruption 11 can be moved towards one another opposing the resilience or restoring force inherent in the locking ring and accompanied by the shortening of the interruption. In the relieved state the locking ring does not fit into the post ring. It only fits when the interruption is shortened and then, when released, it fits rigidly within the post ring.

The interruption 11 is bridged by a U-shaped clip 29 shaped onto the two locking ring ends 12, 13. For each of the two locking ring ends 12, 13 is provided an upwardly directed handle 15, 16, which are positioned along the legs 48, 49 of the clip 29. As a result of the resilience inherent in the clip 29, when the locking ring 10 is compressed its resilience is increased. The clip 29 is shaped onto the locking ring 10. The clip 29 and locking ring 10 are preferably made from a one-piece plastic part.

The clip 29 can also be omitted if the resilience of the locking ring 10 is adequate. The handles corresponding to the handles 15, 16 are then fitted to the two end pieces of the locking ring, as indicated in broken line from in FIG. 1 by 67 and 68. If the resilience of the locking ring 10 is adequate, there is also no need for the portion 69 of the clip 29 between the two handles 15, 16.

Figure 1:
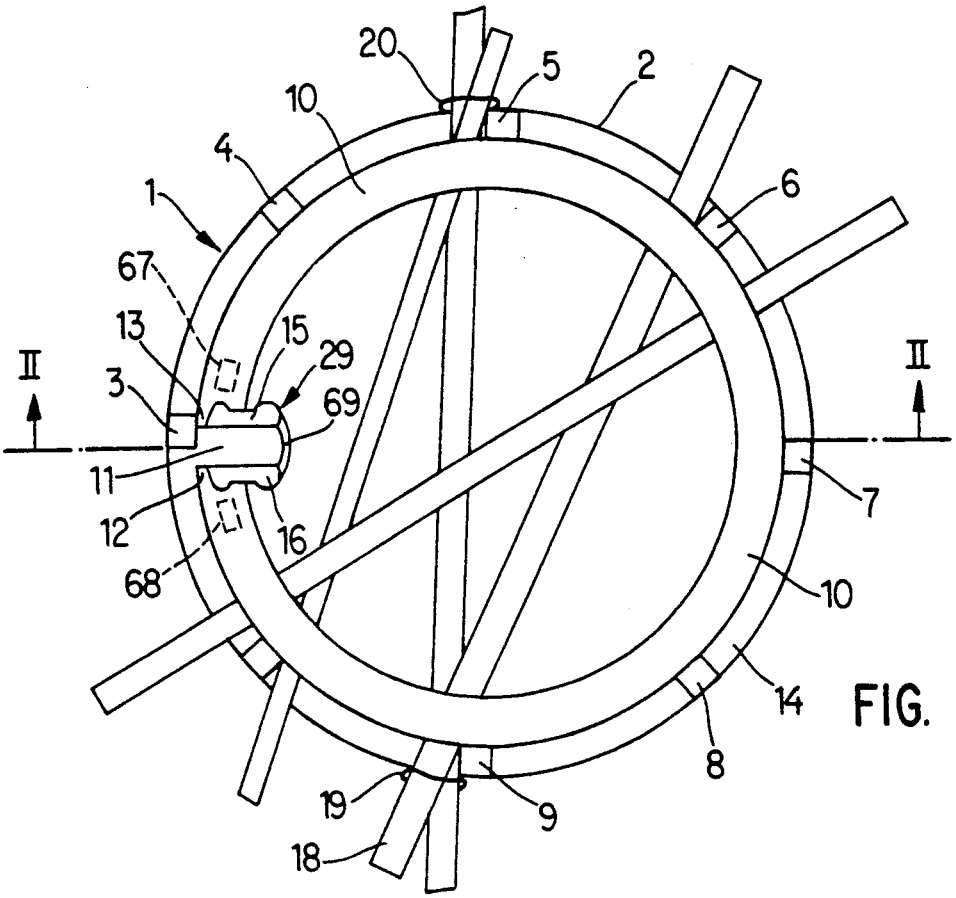
FIG. 1 A placement aid seen from above and namely the central disk equipped with the posts and having an inserted locking ring with straw strips.
Figure 3:
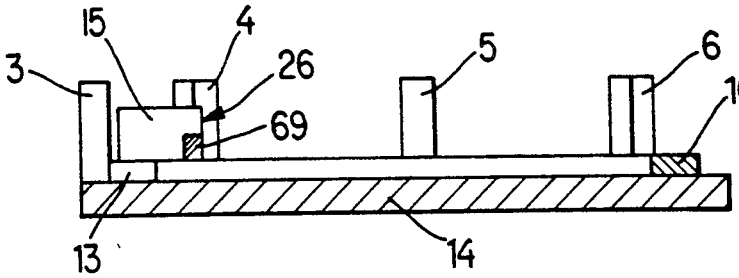
FIG. 3 The section II from FIG. 1 with the locking ring and straw strips.
Figure 4:
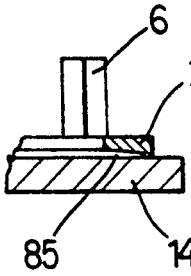
FIG. 4 In detail in the representation of FIG. 3 an embodiment modified compared with that of FIGS. 1 to 3.

The cross-section of the locking ring 10 is positively adapted to the cross-sectional shape of the open space between the surface 17 of the central disk 14 and the inside of the post ring 3, 4 and according to FIGS. 1 to 3 is shaped like a rectangle. In the variant of FIG. 4, the cross-section of the locking ring 39, which corresponds to the locking ring 10 of FIGS. 1 to 3, is shaped like a trapezium with the narrow side to the inside, so that between the locking ring 39 and the central disk 14 a wedge-shaped gap 85 is left free with its tip directed outwards. This aids the frictional force and therefore the seating of the locking ring.

Figure 13:
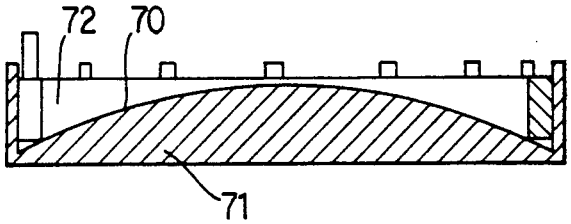
FIG. 13 A placement aid in a view corresponding to FIG. 3 with a domed central disk top and inserted locking ring.

During making the straw strips are placed on the top 17 of the central disk 14 and at both ends between the posts project over the edge of the central disk, as e.g. the straw strips 18 of FIG. 13. The straw strips are formed by the longitudinal slitting of individual straws. The inserted straw strips, which finally form a star shape, are pressed rigidly against one another and against the central disk by the clamping ring 10 inserted and braced from above, so that at their intersecting ends they can easily be connected together by encircling with in each case one cord. Two such cord bindings are shown in FIGS. 1 and 3 and designated 19 and 20.

The tension of the locking ring 10 is chosen in such a way that it can easily be manually inserted in the post ring, but is adequately braced there. As can be gathered from FIG. 3, the locking ring 10 has a rectangular cross-section.

Figure 5:
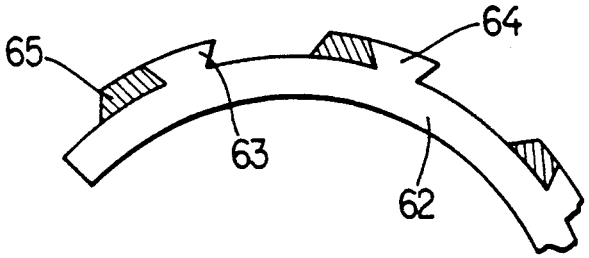
FIG. 5 A portion of a different locking ring inserted in the post ring considered from above with a few cut posts.

The locking ring 62 shown in FIG. 5 has circumferentially distributed, radially outwardly projecting tongues 63, 64, which are so narrow in the circumferential direction that they fit between two adjacent posts, e.g. posts 65, 66 of the associated placement aid. Preferably the tongues 63, 64 are sufficiently wide to fit in clamping manner between two adjacent posts and consequently fix or additionally fix the locking ring in its operating position.

Figure 6:
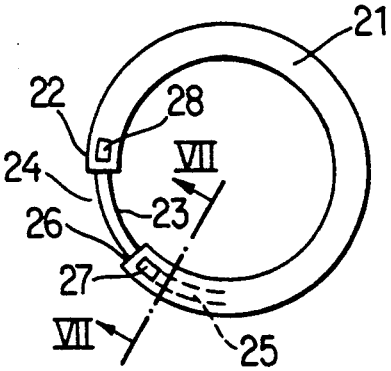

In the case of the locking ring 21 of FIG. 6 a projection 23 is provided on one locking ring end 22 and projects into the interruption 24 so as to completely bridge the same and is housed in a recess 25 at the opposite locking ring end 26. The recess 25 is long enough to enable an adequate compression of the locking ring 21. The handles corresponding to handles 15 and 16 are designated 27 and 28.

Figure 8:
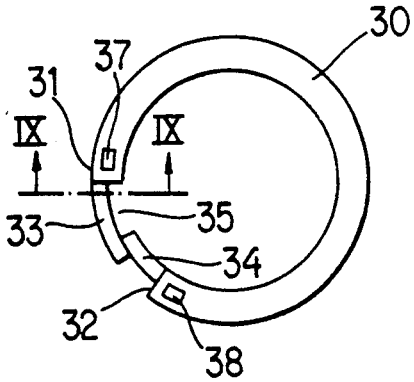
FIGS. 6, 8 & 10 In each case a further development of a locking ring seen from above and in the relieved state.

In the case of the locking ring 30 according to FIG. 8 projections 33, 34 are provided at both locking ring ends 31, 32 and project in reciprocally overlapping manner into the lengthened interruption 35. Each of the projections 33, 34 does not individually extend over the entire length of the lengthened interruption 35 and even if the locking ring has been adequately compressed to fit into the post ring, still finds sufficient space in the interruption 35. If this is not the case, then in the in each case facing locking ring end 31, 32 there is a recess, such as the recess 36 visible in the sectional representation of FIG. 9, which is used for the projection 34. The two handles 37, 38 correspond to the handles 15, 16.

Figure 10:
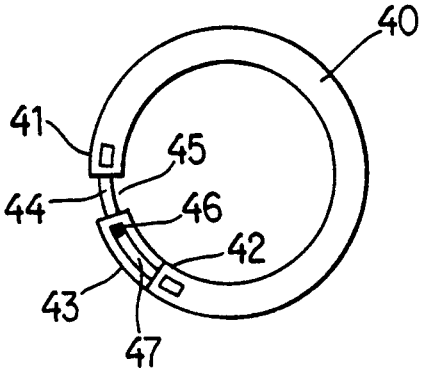

In the case of the locking ring 40 shown in FIG. 10 projections 43, 44 are fixed to the two locking ring ends 41, 42 and project into the interruption 45. The free end of the projection 44 in constructed as an angular nose 46 and fits in a guide slot 47 of the projection 43. At the end of the guide slot 47 the nose 46 finds a stop, which prevents any further expansion of the interruption. In the indicated position the locking ring 40 is still under tension, which is directed at a further expansion of the interruption 45. In FIG. 10 the locking ring does not fit in the associated post ring, but in order to fit in the latter it only has to have a slight narrowing of its interruption. In the fitting position the nose 46 does not quite reach the other end of the guide slot 47.

Figure 9:
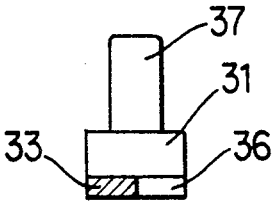
FIG. 9 The partial section IX of FIG. 8.
Figure 7:
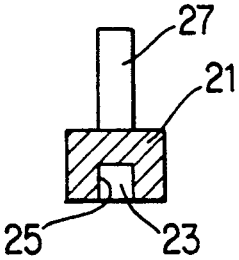
FIG. 7 The partial section VII of FIG. 6.

It is noteworthy in the constructions of FIGS. 8 to 10, that the projections are aligned with the underside of the locking ring, i.e. with that side fitted in the post ring rests on the straw strip, so that the projections prevent straw strip portions from deflecting upwards into the interruption.

In the embodiment according to FIGS. 1 to 3 the central disk surface 17 on which the straw star is formed is a plane. In the embodiments of FIGS. 11 to 16 the said surface 50 is curved or domed upwards. This domed surface 50 is obtained by a correspondingly shaped insert part 51, which is inserted in a placement aid 52. The latter is constructed as described relative to FIG. 1, i.e. it comprises a flat, circular central disk 53 and upwardly projecting posts 54 to 57, which uniformly distributed over the circumference form a ring.

The associated locking ring 58, which is constructed and inserted as a loose part, has a roughly trapezoidal cross-section, so that it positively matches the annular space formed by the posts on the one hand and the surface 50 on the other.

The insert part 51 is provided with several circumferentially distributed radial tongues 59, 60, which are so narrow in the circumferential direction that they fit in clamping manner between two adjacent posts, e.g. the tongue 59 between the posts 54, 55 and consequently adequantely fix the insert part 51 in the inserted state.

As a modification of the represented insert part 51, the radial tongues 59, 60 etc. can be omitted and then said insert part with a circular circumference can fit positively into the post ring and is adequately held there by gravity.

Between insert part 51 and the locking ring 58 a curved or domed star is formed from straw strips, in the manner indicated in dot-dash line form at 61. For this purpose the straw strips are preferably precurved, in that they are drawn between two fingers pressed against one another and namely the original inside is drawn along the transversely positioned thumb nail and the original outside along the index finger tip.

Figure 11:
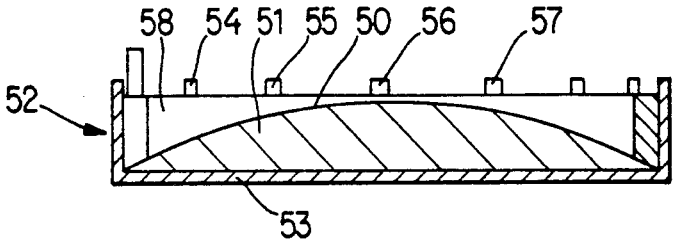
FIG. 11 A placement aid in the sectional representation corresponding to FIG. 3 with a domed insert part and inserted locking ring.

The embodiment according to FIG. 11 can also be used for producing flat straw stars and for this purpose the insert part 51 is omitted. The trapezoidal cross-section of the locking ring 58 is not of an optimum nature for this purpose, but is still adequate. As a variant and if it is frequently necessary to change from flat to domed straw stars, it is possible to use a locking ring with a rectangular cross-section, such as e.g. the locking ring 72 in FIG. 13.

The embodiment of FIG. 13 differs from that of FIG. 11 only in that the domed surface 70 corresponding to the domed surface 50 is formed by the central disk 71, which is correspondingly domed. Thus, no separate insert part is required. For reasons of simplicity, the locking ring 72 has a rectangular cross-section.

Figure 14:
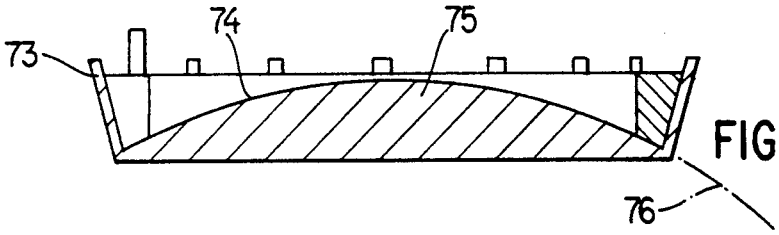
FIGS. 14, 15 & 16 Modified constructions of placement aids in the sectional view of FIGS. 3 or 13.

In the embodiment shown in FIG. 14 the damed surface 74 is formed by the central disk 75. The posts, e.g. post 73, are not at right angles to the plane defined by the central disk and instead are slightly outwardly inclined to such an extent that they stand vertically on the associated curvature corresponding to the tangent 76. The cross-section of locking ring 77 is positively adapted to the damed surface 74 and the posts.

Figure 15:
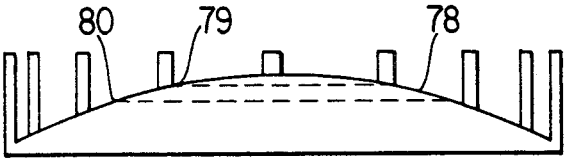
Figure 16:
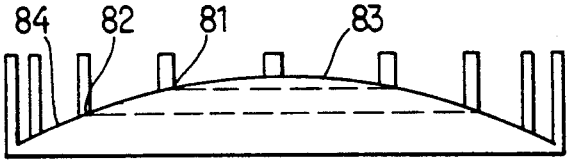
Figure 12:
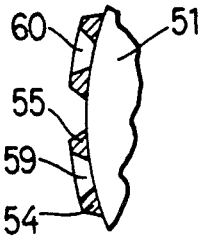
FIG. 12 Detail of the insert part of FIG. 11 in the direction of arrow XII, i.e. from above, shown with a few associated, cut posts.

FIGS. 15 and 16 do not show the locking ring. Both embodiments are very similar to that of FIG. 13, the only difference being that according to FIG. 13 the damed surface 70 is round, whereas the damed surface 78 has circular bending edges 79 and 80 and there are circular cone-shaped portions between said edges.

In the embodiment of FIG. 16 there are also circular bending edges 81, 82 in the domed surface 83. The portions between these bending edges, e.g. the portion 84, are slightly curved.

In the embodiments to be described hereinafter the locking rings are not shown, but can be constructed in accordance with the description relative to FIGS. 1 to 10 and their size is adapted to the particular post ring used.

In FIGS. 17 and 18 is shown a placement aid 90, which is constructed in the same way as the placement aid 1 of FIG. 1. Its posts 91 etc. and its top 92 are directed downwards and radially outwardly extended by a fitted extension ring 93. The top 94 of this extension ring 93 points upwards and is aligned with the smooth underside 95 of the central disk 96 of the placement aid 90.

The inner circumference 97 of the extension ring 93 is placed on the outer circumference 98 of the central disk 96 and is detachably secured by circumferentially distributed, shaped-in notches 100, 101. On its circumference the extension ring 93 has uniformly distributed, centrosymmetrically arranged, identically long posts 102, which extend at right angles to the surface 94.

The placement aid formed by the central disk 96 and the extension ring 93 is provided with straw strips for forming a star and longer straw strips can be used, so that a larger star is obtained. The posts 102 etc. of the extension ring 93 are used for guidance purposes, whereas the posts 91 etc. of the placement aid 90 have no function. If smaller straw stars are to be made, the extension ring is removed again, the placement aid 90 is turned round and used as described relative to FIGS. 1 to 3. Thus, for the post ring of posts 91 etc. a small locking ring is available, whereas a larger locking ring is available for the post ring of posts 102 etc.

As a modification to the embodiment of FIGS. 17 and 18 the posts 91 etc. of the placement aid 90 can also be removable. They are then removed when not required, so that they do not constitute a hindrance on the underside. This leads to a large placement aid formed from the central disk 110, an extension ring 111 and the posts 112 etc. associated with the latter and the size thereof can be reduced by removing the extension ring 111 and by inserting the posts, e.g. the post 112, back in the holes 113 etc. provided.

Figure 22:
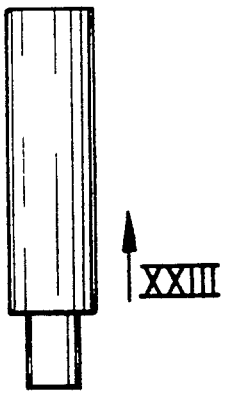
FIG. 22 An insertable post, whose plug has an offset tapering.
Figure 23:
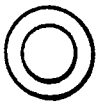
FIG. 23 The view along arrow XXIII in FIG. 22.
Figure 24:
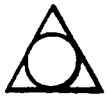
FIGS. 24 to 28 Modified post embodiments in the view corresponding to FIG. 23.
Figure 25:
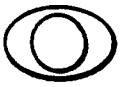
Figure 26:
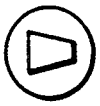
Figure 27:
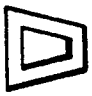
Figure 28:
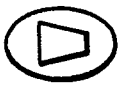

For this purpose the removable posts can be shaped in a functionally correct manner, e.g. in the same way as the post 114 in FIGS. 22 and 23, which has at its upper end a circular cross-section 115 and has at its lower end a plug 116, which fits into a central disk hole corresponding to the hole 113.

Modified embodiments can be gathered from FIGS. 24 to 28. Particular reference is made to the plugs with trapezoidal cross-section of FIGS. 26, 27 and 28 for which, as shown in FIG. 20, trapezoidal holes 113 etc. are provided, whose wide side is directed radially inwards and which offer a particularly secure hold.

Figure 29:
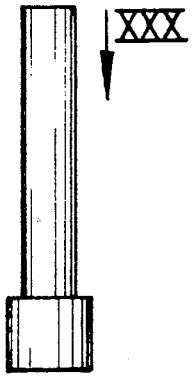
FIG. 29 A post with a thickened plug.
Figure 30:
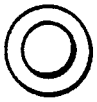
FIG. 30 The view along arrow XXX of FIG. 29.
Figure 31:
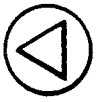
FIGS. 31 to 35 Modified post constructions in the view corresponding to FIG. 30.
Figure 32:
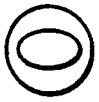
Figure 33:
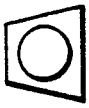
Figure 34:
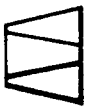
Figure 35:
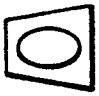
Figure 38:
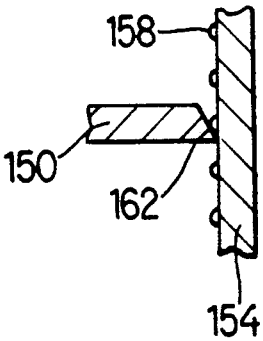
FIGS. 38 to 41 In each case in detail in the representation a post and a locking ring of modified embodiments equipped with sliding brakes.
Figure 39:
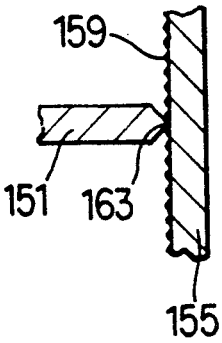
Figure 40:
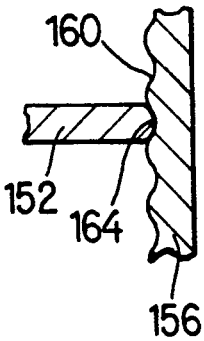
Figure 41:
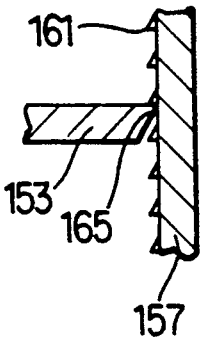

Instead of a tapered plug construction, the plug can also be made broader, like the plug 117 of the post 118. Different cross-sectional shapes are also possible. The cross-sectional shape of FIG. 30 belongs to FIG. 29 and modifications are shown in FIGS. 31 to 35.

Figure 36:
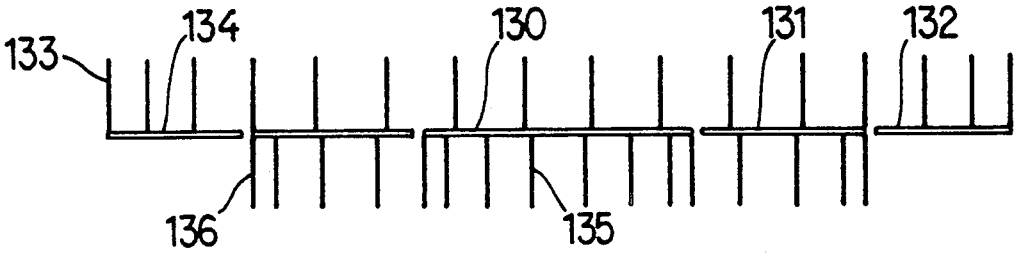
FIG. 36 A placement aid enlarged by two extension rings in the sectional view corresponding to FIG. 18.

A placement aid can also be enlarged by more than one extension ring, e.g. by two extension rings as shown in FIG. 36. FIG. 36 shows a placement aid 130 corresponding to the placement aid 1 of FIG. 1, which is fitted in reversed manner, i.e. with its top directed downwards. Around said placement aid 130 is fitted a first extension ring 131, whose associated posts are also directed downwards, i.e. are fitted in reversed manner. Around said first extension ring 131 is placed a second extension ring 132, whose posts 133 and surface 134 are directed upwards and whose surface 134 forms a through working surface with the backs of the extension ring 131 and the placement aid 130 on which can be placed the straw strips. The posts 135 etc. of the placement aid 130 and the posts 136 etc. of the extension ring 131 are directed downwards and filfil no function.

Figure 37:
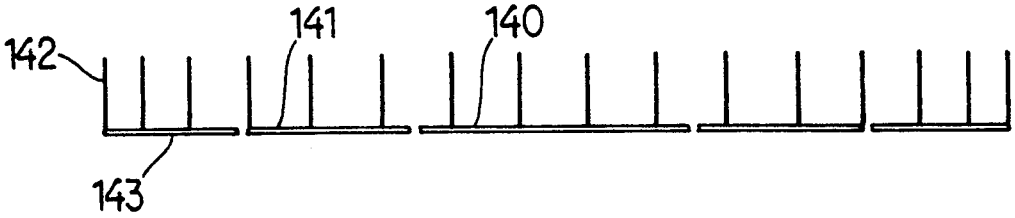
FIG. 37 A placement aid in the sectional view corresponding to FIG. 18 enlarged by two extension rings, but in which the posts in the way have been removed.

In the embodiment of FIG. 37 the functionless posts of the placement aid 140 and the first extension ring 141 are removable and are actually removed because they are not momentarily required, so that only the functionally required posts 142 etc. of the second extension ring 143 are present. Otherwise the embodiment of FIG. 37 is the same as that of FIG. 36.

Extracts of four modified embodiments are shown in FIGS. 38 to 41. Only parts of each locking ring 150 to 153 and one belonging post 154 to 157 of the belonging post ring are shown. According to these embodiments on the outside of each locking ring and on the inside of the posts sliding brakes 158 to 165 are provided, which sliding brakes are formed according FIG. 38 by naps 158 at the post and by a downwardly directed barb 162 on the locking ring; according FIG. 39 by naps 159 on the inside of the posts and by a sharpened edge 163 on the outside of the locking ring; according FIG. 40 by horizontally extended shafts 160 on the post 156 and by a curvature 160 fitted therein on the outside of the locking ring and according FIG. 41 by downwardly directed barbs 161 on the inside of the posts and by a barblike upwardly directed edge 165 on the outside of the locking ring.

The described parts of all the embodiments, namely the central disk, the extension rings with the shaped on or insertable posts and the locking rings are preferably made from plastic, but can also be made from metal or wood.

What is claimed is:

1. A placement aid for making straw stars, comprising a placement part including a central disk having a top surface, a ring of vertical posts anchored in said disk, a loose locking ring which fits in positive rigid manner in the ring of posts under elastic bracing, the locking ring having in its circumference an opening-forming interruption and the two ring ends bounding the opening being movable towards one another in opposition to a resilience inherent in the locking ring to shorten the interruption and wherein, with the interruption shortened, the locking ring fits with clearance into the ring of posts but does not when the interruption is lengthened, and a U-shaped clip bridging said interruption.

2. A placement aid according to claim 1, wherein each of the locking ring ends has a handle remote from the central disk when the locking ring is inserted, said handles being positioned along the legs of the U-shaped clip.

3. A placement aid according to claim 1, wherein projections projecting into the interruption are provided on one or both locking ring ends and in the case of projections on both locking ring ends such projections overlap when the interruption is lengthened and are out of alignment with one another but are in alignment with the locking ring ends.

4. A placement aid according to claim 3, wherein recesses (36) are provided for the projection or projections (34) in the in each case facing locking ring end (31) in which is housed the particular projection with the interruption (35) shortened.

5. A placement aid according to claim 3, wherein in each case one projection (43, 44) is provided on each of the locking ring ends (41, 42) and said projections have opposite guides (46, 47) and form a stop limiting the expansion of the interruption (45) in a state in which the resilience inherent in the locking ring (40) is directed at an even greater expansion of the interruption, but the locking ring does not fit into the post ring.

6. A placement mat according to claim 1, wherein the cross-section of the locking ring conforms to the cross-section of an open space between the top surface of the central disk and the inside of the ring of posts.

7. A placement mat according to claim 1, further comprising a brake having cooperating portions provided on said locking ring and said posts.

8. A placement mat according to claim 1, further comprising a loose extension ring coaxially and rigidly seated on the circumference of said central disk, said ring of posts being anchored in said extension ring.

9. A placement aid according to claim 8, wherein the top (50) of the central disk (53) is curved upwards in centrosymmetrical manner and formed by a loose insert part (51) fitting positively on the central disk (53) and between the post ring (54, etc.).

* * * * *